United States Patent [19]

Koerner et al.

[11] 4,182,682

[45] Jan. 8, 1980

[54] PREPARATION FOR SHRINKPROOFING WOOL AND PROCESS FOR THE PRODUCTION OF THE PREPARATION

[76] Inventors: Götz Koerner, Kantorie 126; Günter Schmidt, Ahornstrasse 47; Friedhelm Nickel, Lortzingstrasse 10, all of 4330 Essen, Fed. Rep. of Germany

[21] Appl. No.: 968,766

[22] Filed: Dec. 12, 1978

[30] Foreign Application Priority Data

Dec. 22, 1977 [GB] United Kingdom ..... 53571/77

[51] Int. Cl.[2] ..... D06M 13/10

[52] U.S. Cl. ..... 252/8.6; 8/115.6; 260/448.2 N; 528/23

[58] Field of Search ..... 252/8.6; 8/115.6; 260/448.2 N; 528/23

[56] References Cited

U.S. PATENT DOCUMENTS

| | | | |
|---|---|---|---|
| 3,849,471 | 11/1974 | Omietanski et al. | 260/448.2 E |
| 4,082,790 | 4/1978 | Speier | 260/448.2 N |
| 4,137,179 | 1/1979 | Koerner et al. | 8/115.6 |

*Primary Examiner*—William E. Schulz

*Attorney, Agent, or Firm*—Toren, McGeady and Stanger

[57] ABSTRACT

A composition for shrinkproofing wool which is composed of 1 to 50 weight percent of organopolysiloxanes containing mercaptoalkyl and mercaptoaryl groups and having between 10 to 1000 silicon atoms per mercaptoalkyl or mercaptoaryl group, and 50 to 99 weight percent water, emulsifiers and organic solvents. The use of the composition provides durable shrinkproofing properties in wool and does not adversely affect the handle of the fabric.

12 Claims, No Drawings

PREPARATION FOR SHRINKPROOFING WOOL AND PROCESS FOR THE PRODUCTION OF THE PREPARATION

BACKGROUND OF THE INVENTION

1. Field of the Invention

The invention relates to a preparation for shrinkproofing wool.

2. Description of the Prior Art

It is well known that wool, when washed in the untreated state in aqueous liquors, shrinks and felts. In order to counteract this shrinkage and felting, chemical treatments which change the structure of the wool or finishes containing resin, which is deposited on the surface of and envelops the wool fibers, have been used. Each of these processes, however, provides products which the consumer finds have an uncomfortable "handle".

It has also already been recommended that the shrinkage of wool on washing may be reduced by treatment with organosilicon compounds. Such processes are described in British Pat. Nos. 594,901, 613,267 and 629,329. In accordance with these processes, the wool is treated with certain silanes.

A process is described in British Pat. No. 746,307 for preventing the shrinkage of wool by finishing the wool fibers with particular organopolysiloxanes. A certain degree of shrinkproofing is achieved by this procedure. However, the effect is not washfast.

In another series of publications, for example, German Offenlegungsschriften Nos. 22 42 297; 23 35 751; 25 23 270, processes are described for shrinkproofing keratin fibers by applying organopolysiloxanes which contain a specific amino group content as an essential characteristic. For example, the process according to German Offenlegungsschrift No. 22 42 297 is characterized by the fact that, as the organopolysiloxane, a material is used having units of the following general formula $$R_nSiO_{(4-n)/2}$$

in which n has an average value of 1.9 to 2.1 and

R represents an organic residue, attached to silicon by a silicon-carbon bond, 0.25 to 50% of the R substituents being monovalent residues with fewer than 30 carbon atoms which, at a distance of at least 3 carbon atoms from the silicon atom, contain at least one amino group and at least one primary or secondary amino group —$NX_2$, in which X is a hydrogen atom, an alkyl group with 1 to 30 carbon atoms or an aryl group, the remaining R substituents being monovalent hydrocarbon residues, halogenated hydrocarbon residues, carboxyalkyl residues or cyanoalkyl residues with 1 to 30 carbon atoms, of which at least 70% consist of monovalent hydrocarbon residues with 1 to 18 carbon atoms.

A process for treating keratin fibers is known from German Offenlegungsschrift No. 23 25 751, which is characterized by the fact that the organopolysiloxane composition contains the product obtained by mixing (A) and (B), where (A) is a polydiorganosiloxane with terminal hydroxyl groups attached to the silicon atoms and a molecular weight of at least 750, and wherein at least 50% of the organic substituents of the polydiorganodisiloxane are methyl groups and the other substituents represent monovalent hydrocarbon groups with 2 to 30 carbon atoms; and (B) is an organosilane of the general formula $$RSiR'_nX_{3-n}$$

in which

R represents a monovalent group formed from carbon, hydrogen, nitrogen and, optionally, oxygen, which contains at least two amino groups and is attached to silicon by a silicon-carbon bond, R' represents an alkyl group or an aryl group, X represents alkoxy groups with 1 to 4 carbon atoms inclusive, wherein n is zero or 1 and/or X is a partial hydrolysate and condensate of the organosilane.

It is stated in this German Offenlegungsschrift that the two components of the mixture must be reacted if they are to be applied from an aqueous medium. Practical experiments have shown, however, that it is impossible to prepare stable aqueous emulsions from such reaction products. The reaction products formed are gel-like and cannot be converted to the emulsion form. They are, therefore, not suitable for making wool shrinkproof.

If these reaction products are used in the form of organic solutions, it turns out that the shrinkproofing effect is so slight that they cannot be used successfully in practice. Moreover, the moisture in the air causes a siloxane gel to separate out from the liquor containing the solvent after some time. This siloxane gel clogs up the equipment used for treating the wool.

German Offenlegungsschrift No. 17 69 249 teaches another process for treating fibrous material, e.g., wool, according to which organosiloxanes, containing mercaptopropyl groups, are used in emulsion form. With these compounds, however, it is only possible to decrease the soilability. The compounds are not suitable for making wool shrinkproof.

Furthermore, a hair treating material is known from German Offenlegungsschrift No. 16 17 443, which is based on organosilicon compounds and characterized by containing an organosiloxane copolymer of the general formula

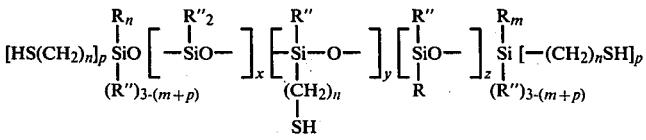

in which

R is an alkyl residue with at least 8 carbon atoms,

R'' is a lower alkyl residue with 1–7 carbon atoms, n is a whole number not less than 2, p is 0, 1 or 2, m is 0, 1 or 2, the sum of m+p has a value from 0 to 2, x is a whole number not less than 1, y and z each are 0 or a whole number with the proviso that when y=0, p is at least 1 and in the case that z=0, m is at least 1 and x is greater than the sum of y+z.

These compounds are also not suitable for shrinkproofing wool. Thus, these disclosures do not suggest the structure of an organopolysiloxane which would be suitable for shrinkproofing wool.

SUMMARY OF THE INVENTION

We have discovered a preparation for shrinkproofing wool which contains compounds, in emulsion form as well as in the form of a solution in an organic solvent, which are suitable for shrinkproofing wool so that the shrinkproofing property of the wool is retained even after several washings in conventional washing machines. In particular, we have discovered a preparation from which the active material does not precipitate even when standing while exposed to moist air and which is stable over a prolonged period, even when stored in the form of an emulsion. At the same time, the active material contained in the preparation does not adversely affect the so-called "handle" of the wool or of materials knitted or woven from the wool.

We have discovered that these properties are to be found in a preparation which consists of (a) 1 to 50 weight % of organopolysiloxanes, having mercaptoalkyl or mercaptoaryl groups, which are constructed from (aa) 90 to 99.9 mole% of units having the formula $$R_nSiO_{(4-n)/2} \qquad \text{I}$$

in which

R is a methyl residue, up to 10 mole% of which, however, may be replaced by alkyl residues with a longer chain length or by aryl residues and up to 5 mole% of which may be replaced by mercaptoalkyl or mercaptoaryl residues, n has a value of 1.8 to 2.0, and (ab) 0.1 to 10 mole% of units having the formula $$R'SiO_{3/2} \qquad \text{II}$$

in which R' is an alkyl residue and/or a mercaptoalkyl or mercaptoaryl residue and/or $O_{0.5}$ and/or a hydrogen residue, and which corresponds to the condition that the organopolysiloxane contains 10 to 1000 silicon atoms per mercaptoalkyl/mercaptoaryl group, whilst up to 10 mole% of the oxygen atoms attached to silicon may in each case be replaced by two OR" groups, in which R" represents a lower alkyl residue and/or a hydrogen residue, and (b) 50 to 99 weight % of water, emulsifiers or organic solvents and, optionally, conventional additives, such as, for example, flame retardants.

The R residue of Structure Unit I is a methyl residue. Up to 10 mole% of the methyl residues in this structure unit may be replaced by alkyl residues with a longer chain length or by aryl residues. Examples of such residues are ethyl, propyl, dodecyl or phenyl residues.

Up to 5 mole % of the methyl residues may be replaced by mercaptoalkyl/mercaptoaryl residues. Examples of such residues are mercaptomethyl, 2-mercaptoethyl and 3-mercaptopropyl, as well as 4-mercaptophenyl residues.

The R' residue in Structure Unit II represents an alkyl residue but may, however, be a mercaptoalkyl or a mercaptoaryl residue and/or $O_{0.5}$ and/or a hydrogen residue. These residues may occur side by side in different molecules. Examples of such residues are methyl, ethyl, mercaptomethyl, 2-mercaptoethyl, 3-mercaptopropyl or 4-mercaptophenyl residues.

Up to 10 mole % of the oxygen atoms which are attached to silicon in the structure units may, in each case, be replaced by two OR" groups, in which R" is a lower alkyl residue.

A particularly preferred preparation is one in which all the R residues are methyl residues and all the R' residues are mercaptoalkyl residues. Especially preferred is the 3-mercaptoproply residue.

Preferably, the index n is 2.0, in which case, the unit depicted as I has a linear structure.

In addition, there is preferably one mercaptoalkyl/mercaptoaryl group for every 75 to 300 silicon atoms of the organopolysiloxane.

Units I and II may be distributed at random within the molecule. However, organopolysiloxanes are preferred in which the Structure Units I and II are each contained in blocks.

The preparations are sprayed onto wool which may be in the form of fiber, yarn, or woven or knitted materials. The material to be treated may also be dipped into the emulsion or solution of the aforementioned organopolysiloxanes and subsequently squeezed by a conventional padding procedure to remove excess liquid. The wool, so treated, is then dried or freed from solvent. It is a particular advantage of the present process that the organopolysiloxanes which are contained in the preparation do not have to be fixed on the wool fiber by a separate heat treatment. Thus, the organopolysiloxane is completely set at normal room temperature after the water or solvent has been evaporated. In the treated state, the wool should contain between 0.3 to 5, and preferably, 0.5 to 3 weight percent of active material.

If the preparation of polysiloxanes, in which a portion of the oxygen atoms which are attached to a silicon atom, are replaced by OR" groups, these groups react in water or in moist air, splitting off R"OH and forming compounds in which, in each case, one oxygen atom links two silicon atoms and takes the place of two OR" groups.

Instead of polysiloxanes containing mercaptoalkyl or mercaptoaryl groups, it is also possible to use polysiloxanes containing groups which convert to mercaptoalkyl or mercaptoaryl groups in the preparation. Examples of compounds which form mercapto groups are the corresponding isothioronium compounds:

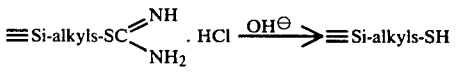

or group of compounds known as Bunte salts

Should this preliminary stage not be converted completely to the corresponding mercaptoalkyl/mercaptoaryl compounds during the preparation, the remaining conversion will take place on the fiber.

The invention furthermore relates to a process for the production of the compound of the present invention. In this process, a diorganopolysiloxanediol, having the structure $$HO(R_2SiO)_mH$$

and a viscosity of 100 to 100,000 cps at 20° C., in which m is a whole number greater than 1, is emulsified in water, preferably in the presence of emulsifiers, or dissolved in organic solvents. A mercaptohydrocarbonsilane, whose structure may be represented by $$HS—R'''—Si(OR'')_3$$

in which R''' is an alkyl or aryl residue, is added to the emulsion or solution, such that the desired ratio of mercaptoalkyl or mercaptoaryl groups to silicon atoms is obtained and the reactants are reacted with one another, if necessary, at an elevated temperature. At the same time, a partial hydrolysate of the above mercaptohydrosilane may also be used.

The indexes R and R'' have the same meaning as that already given. The R''' group is an alkyl or aryl residue and preferably is an alkyl residue with one to three carbon atoms or the phenyl residue.

If an aqueous emulsion is prepared, it is advantageous to use emulsifiers which are well known in the art in order to form and stabilize the emulsion. Cationic emulsifiers are particularly suitable for this purpose.

Examples of such emulsifiers are didecyldimethylammonium chloride and dioctadecyldimethylammonium chloride as well as the coresponding hydroxides. Also suitable are betaines having structures, such as, $$C_{12}H_{25}CONHCH_2CH_2\overset{\overset{CH_3}{|}}{\underset{\underset{CH_3}{|}}{N}}{}^{\oplus}CH_2COO^{\ominus}$$

as well as mixtures of cationic compounds and nonionic compounds. The nonionic emulsifiers may be obtained by the addition of ethylene oxide to compounds with acidic hydrogen atoms. Addition products of ethylene oxides and aliphatic alcohols with 8 to 13 carbon atoms or addition products of ethylene oxide and alkylated phenols, e.g., nonylphenol, are particularly suitable. Anionic emulsifiers, such as, for example, alkali, ammonium or amine salts of sulfonic acids, especially alkylsulfonic/arylsulfonic acids, for example, dodecylbenzenesulfonic acids, are furthermore suitable.

For the reaction between the two reactants, it is advisable to stir the emulsion or the organic solution. While the reaction proceeds of its own accord at room temperature, the rate of the reaction may be accelerated by increasing the temperature to a level, for example, of 40° to 99° C.

Organic solvents which may be used include hydrocarbons and chlorinated hydrocarbons, for example, toluene, xylene and white spirits or 1,1,1-trichloroethane.

EXAMPLES 1-8

Into a reaction vessel are added 630 g of water, 4.3 g of didecyldimethylammonium chloride, 2.2 g of dioctadecyldimethylammonium chloride, 4.6 g of a betaine having the structure $$C_{12}H_{25}CONHCH_2CH_2\overset{\overset{CH_3}{|}}{\underset{\underset{CH_3}{|}}{N_2}}{}^{\oplus}CH_2COO^{\ominus}$$

and 16 g of a 1 molar potassium hydroxide solution. The mixture is heated with stirring to 95° C.

In order to prepare the organopolysiloxanes (a) consisting of units (aa) and (ab), the compounds, listed in Table I are added from a dropping funnel in the given amounts to the solution of emulsifiers.

After the addition of the various components is completed, the mixtures are, in each case, stirred vigorously for 60 minutes. The emulsions are then cooled to 40° C. and the alkaline liquor obtained is neutralized by the addition of 20 g of 10% acetic acid.

TABLE I

| No. | (aa) | $RnSiO_{\frac{4-n}{2}}$, formed from | | (ab) | $R'SiO_{3/2}$, formed from | R' |
|---|---|---|---|---|---|---|
| 1 | 207.2g<br>124.6g | (0.7moles)octamethylcyclotetrasiloxane +<br>(0.7moles)methyltriethoxysilane | n = 1.8<br>R = $CH_3$ | 4.5g<br>2.0g | (0.0187moles)3-mercaptopropyltriethoxysilane +<br>ethanol | R' = $HS—(CH_2)_3—$ |
| 2 | 222.00g<br>4.16g<br>10.00g | (0.75moles)octamethylcyclotetrasiloxane +<br>(0.02moles)3-mercaptopropylmethyl-diethoxysilane +<br>ethanol | n = 2<br>R = 99.67mole % $CH_3$<br>R = 0.33mole % $HS—(CH_2)_3—$ | 3.56g | (0.02moles)methyltriethoxysilane | R = $—CH_3$ |
| 3 | 222.00g<br>8.00g | (0.75moles)octamethylcyclotetrasiloxane +<br>ethanol | n = 2<br>R = $CH_3$ | 4.76g<br>2.00g | (0.02moles)3-mercaptopropyltriethoxysilane<br>ethanol | R'= $HS—(CH_2)_3—$ |
| 4 | 222.00g<br>8.00g | (0.75moles)octamethylcyclotetrasiloxane +<br>ethanol | n = 2<br>R = $CH_3$ | 6.72g<br>3.00g | (0.03moles)3-mercaptoethyltriethoxysilane<br>ethanol | R' = $HS(CH_2)_2—$ |
| 5 | 222.00g<br>8.00g | (0.75moles)octamethylcyclotetrasiloxane +<br>ethanol | n = 2<br>R = $CH_3$ | 6.32g<br>3.00g | (0.025moles)3-mercaptoisobutyltriethoxysilane<br>ethanol | R' = $HS—CH_2—\overset{\overset{CH_3}{\vert}}{CH}—CH_2—$ |
| 6 | 222.00g<br>4.16g<br>10.00g | (0.75moles)octamethylcyclotetrasiloxane +<br>(0.02moles)3-mercaptopropylmethyl-diethoxysilane<br>ethanol | n = 2<br>R = 99.67mole % $CH_3$<br>R = 0.33mole % $HS—(CH_2)_3—$ | 4.92g<br>2.00g | (0.03moles)triethoxysilane<br>ethanol | R' = —H |

TABLE I-continued

| No. | (aa) | $RnSiO_{\frac{4-n}{2}}$, formed from | | (ab) | $R'SiO_{3/2}$, formed from | R' |
|---|---|---|---|---|---|---|
| 7 | 222.00g<br>8.00g | (0.75moles)octamethylcyclotetrasiloxane +<br>ethanol | n = 2<br>R = $CH_3$ | 5.47g<br>3.00g | (0.02 moles)<br>$(CH_3O)_3Si-(CH_2)_3-SC(=NH)NH_2 \cdot HCl$<br>ethanol | R' = $-(CH_2)_3-SC(=NH)NH_2 \cdot HCl$ |
| 8 | 194.00g<br>35.90g<br>10.00g | (0.655moles)Octamethylcyclotetrasiloxane<br>(0.13moles)methyl-dodecyldiethoxysilane<br>ethanol | n = 2<br>R = 2.36mole % $C_{12}H_{25}$<br>R = 97.64mole % $-CH_3$ | 5.13g | (0.026moles)3-mercaptopropyltrimethoxysilane | R = $HS-(CH_2)_3-$ |

EXAMPLE 9

A siloxane copolymer is prepared by heating together 3.75 parts of 3-mercaptopropylmethyldiethoxysilane and 1000 parts of an $\alpha,\omega$-polydimethylsiloxanediol with a viscosity of ca. 3000 cps (25° C.).

Heating is carried out at a temperature of 160° C. for two hours under nitrogen, while stirring vigorously. The copolymer formed is a clear liquid with a viscosity of ca. 4300 cps (25° C.). By incorporating 18.2 parts of 3-mercaptopropyltriethoxysilane into the copolymer, a preparation is obtained which may be applied onto the wool material to be treated from a solvent. Corresponding to the formula shown hereinabove, the copolymer consisted of units (aa), in which n=2 and 0.1 mole % of the methyl residues R are replaced by $HS(CH_2)_3$ residues, and units corresponding (ab), in which R' represents 3-mercaptopropyl residues. In order to prepare an aqueous formulation, 30 parts of the previously described mixture are added to a mixture of 3 parts of a condensation product of coconut oil fatty amine with 20 moles of ethylene oxide and 67 parts of water. A stable siloxane emulsion in water is obtained by stirring vigorously with a high-shear stirrer.

EXAMPLE 10

(Comparison example corresponding to German Offenlegungsschrift No. 23 65 977)

A mixture of the following compounds was prepared:

| | |
|---|---|
| Polydimethylsiloxane with terminal ≡Si—OH and a molecular weight of 45,000 (3000 cst) | 90 parts by weight |
| $(CH_3O)_3Si(CH_2)_3NH(CH_2)_2NH_2$ | 5 parts by weight |
| a partial condensate of $H_3CSi(OCH_3)_3$ | 5 parts by weight |

An amount of this mixture, required for preparing the impregnating solution, is dissolved in toluene and diluted to the concentration desired for use.

An Example of the Application

A knitted material of fine wool is treated with the preparations of Examples 1 to 10 in such a way that 1% solids are applied when the impregnated material is simply dried at 90° C. In the case of the inventive Examples 1–9, drying may also take place at room temperature, since the preparations described in these examples contain organopolysiloxanes which completely harden at this temperature.

After a 24-hour storage period at 20° C., finished as well as untreated material was washed in a domestic washing machine at 40° C. with the addition of 4 g/l of Perox-Nadelseife (needle soap) and 2 g/l soda. The material was dried between washings in a tumble drier. After ten washings, each lasting 20 minutes, the area shrinkage due to felting was determined. The area shrinkage due to felting was calculated according to the following formula:

Area shrinkage due to felting $=\%L+\%W-(\%L\times\%W)/100$

%L=length shrinkage in percent

%W=width shrinkage in percent

The following values were determined:

| Sample | Area Shrinkage due to Felting |
|---|---|
| Untreated Material | 44.0% |
| Example 1 | 5.1% |
| Example 2 | 4.4% |
| Example 3 | 2.3% |
| Example 4 | 4.2% |
| Example 5 | 2.9% |
| Example 6 | 3.1% |
| Example 7 | 3.6% |
| Example 8 | 4.0% |
| Example 9 (a) from 1,1,1-trichloroethane | 5.0% |
| Example 9 (b) from aqueous liquor | 4.6% |
| Example 10 | 5.2% |

In contrast to the treated materials, the sample, which had not been finished, showed severe felting on the surface. Moreover, the handle of the treated samples after washing was significantly softer than the handle of the untreated material after washing and was similar to the handle before washing. The handle of Sample 8 differed from that of the other samples as a result of a somewhat smoother surface.

What is claimed is:

1. A composition for shrinkproofing wool consisting essentially of (a) 1 to 50 weight % of organopolysiloxanes containing mercaptoalkyl or mercaptoaryl groups which are formed from (aa) 90 to 99.9 mole% of units having the formula $R_nSiO_{(4-n)/2}$ in which R is a methyl residue, up to 10 mole% of may be replaced by alkyl residues with a chain length greater than methyl or by aryl residues and up to 5 mole% of which may be replaced by mercaptoalkyl or mercaptoaryl residues, n has a value of 1.8 to 2.0 and (ab) 0.1 to 10 mole% of units having the formula $R'SiO_{3/2}$ in which R′ is an alkyl residue, a mercaptoalkyl or mercaptoaryl residue, $O_{0.5}$ or a hydrogen residue;

wherein the organopolysiloxane contains 10 to 1000 silicon atoms per mercaptoalkyl or mercaptoaryl group, and up to 10 mole% of the oxygen atoms attached to silicon may be replaced by two OR″ groups, in which R″ represents a lower alkyl residue or a hydrogen residue, and (b) 50 to 99 weight% water, emulsifiers, organic solvents.

2. The composition of claim 1 which contains an organopolysiloxane in which all the R residues are methyl residues.

3. The composition of claims 1 or 2 wherein up to 5 mole percent of the R′ residues are mercaptoalkyl residues.

4. The composition of claims 1 or 2 wherein up to 5 mole percent of the R′ residues are 3-mercaptopropyl residues.

5. The composition of claim 1 wherein n=2.0.

6. The composition of claim 1 wherein the organopolysiloxane contains 75 to 300 silicon atoms per mercaptoalkyl or mercaptoaryl group.

7. The composition of claim 1 wherein the structure units $$R_nSiO_{(4-n)/2}$$

and $$R'SiO_{3/2}$$

are present in the form of separate siloxane blocks.

8. A process for making the composition of claim 1 comprising (a) emulsifying a diorganopolysiloxanediol having the structure $$HO(R_2SiO)_mH$$

and a viscosity of 100 to 100,000 cps at 20° C. in which m is a whole number greater than 1, in water;

(b) adding a mercaptohydrocarbonsilane having the structure $$HS—R'''—Si(OR'')_3$$

in which R‴ is an alkyl or aryl residue, to the emulsion in an amount to produce a ratio of 10 to 1000 silicon atoms per mercaptoalkyl/mercaptoaryl group, and (c) allowing the components of the mixture to react with one another.

9. The method of claim 8 wherein the emulsifiers are added to the polysiloxanediol before the emulsifying step.

10. The method of claim 8 wherein the components are reacted at an elevated temperature.

11. A process for making the composition of claim 1 comprising (a) dissolving a diorganopolysiloxanediol having the structure $$OR(R_2SiO)_mH$$

and a viscosity of 100 to 100,000 cps at 20° C., in which m is a whole number greater than 1, in an organic solvent;

(b) adding a mercaptohydrocarbonsilane having the structure $$HS—R'''—SiR(OR'')_3$$

in which R‴ is an alkyl or aryl residue, to the solution in an amount to produce a ratio of 10 to 1000 silicon atoms per mercaptoalkyl/mercaptoaryl group; and (c) allowing the components of the mixture to react with one another.

12. The method of claim 11 wherein the components are reacted at an elevated temperature.

* * * * *